US007002463B2

(12) United States Patent
Wakabayashi

(10) Patent No.: US 7,002,463 B2
(45) Date of Patent: Feb. 21, 2006

(54) SYSTEM AND APPARATUS FOR DETERMINING ABNORMALITIES IN DAILY ACTIVITY PATTERNS

(75) Inventor: Noboru Wakabayashi, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 91 days.

(21) Appl. No.: 10/835,281

(22) Filed: Apr. 30, 2004

(65) Prior Publication Data

US 2005/0125403 A1 Jun. 9, 2005

(30) Foreign Application Priority Data

Dec. 8, 2003 (JP) ..... 2003-408405

(51) Int. Cl.
*G08B 19/00* (2006.01)

(52) U.S. Cl. ..... 340/522; 34/539.13; 34/573.1; 34/573.4; 707/6

(58) Field of Classification Search ..... 340/522, 340/539.13, 573.1, 573.4
See application file for complete search history.

(56) References Cited

U.S. PATENT DOCUMENTS 6,614,348 B1 * 9/2003 Ciccolo et al. ..... 340/541
6,856,249 B1 * 2/2005 Strubbe et al. ..... 340/573.1
2003/0169171 A1 * 9/2003 Strubbe et al. ..... 340/573.1

FOREIGN PATENT DOCUMENTS

JP 2002-352352 A 12/2002
JP 2003-67873 A 3/2003

* cited by examiner

*Primary Examiner*—Daryl C Pope
(74) *Attorney, Agent, or Firm*—McDermott Will & Emery LLP

(57) ABSTRACT

One or more sensors for detecting daily activity patterns are provided in a person's home. A data processing apparatus includes databases for storing activity data from the sensors, a statistical analysis section, an abnormality determination section, an evaluation section and a notification section. The statistical analysis section performs statistical analyses on the stored activity data and calculates thresholds for detecting abnormalities in daily activity patterns. The abnormality determination section compares the living behavioral values with the thresholds calculated by the abnormality determination section and determines abnormalities. The notification section notifies an observer's reporting apparatus of the abnormalities. The observer checks whether the person observed is actually abnormal or not, by communicating with the person; and the observer gives feedback about accuracy of the abnormality notification, enabling the apparatus to learn which daily activity patterns are optimal for the abnormality determination.

10 Claims, 7 Drawing Sheets

| | BATHING TIME DATABASE | | | | | | | |
|---|---|---|---|---|---|---|---|---|
| | | 1ST DAY | 2ND DAY | 3RD DAY | 4TH DAY | 5TH DAY | 6TH DAY | 7TH DAY |
| 401 | BATHING TIME (MIN) | 30 | 30 | 45 | 20 | 20 | 30 | 120 |
| 402 | THRESHOLD | 30 | 30 | 51.47559 | 52.04941 | 50.3548 | 48.68018 | 118.3737 |
| 403 | ABNORMALITY DETERMINATION | NORMAL | NORMAL | NORMAL | NORMAL | NORMAL | NORMAL | ABNORMAL |
| 404 | EVALUATION | | | | | | | ○ |
| 405 | ERROR RATE | 0 | 0 | 0 | 0 | 0 | 0 | 0 |

FIG. 8

| 801 OBSERVED PERSON ID | 802 DESTINATION | 803 COMMUNICATION METHOD |
|---|---|---|
| 001 | 123.123.123.123 | TCP/IP APPLICATIONS |
| | n-w@aaa.com | E-MAIL |
| | ⋮ | ⋮ |
| 002 | ⋮ | ⋮ |

SYSTEM AND APPARATUS FOR DETERMINING ABNORMALITIES IN DAILY ACTIVITY PATTERNS

CLAIM OF PRIORITY

The present application claims priority from Japanese application serial no. P2003-408405, filed on Dec. 8, 2003, the content of which is hereby incorporated by reference into this application.

BACKGROUND OF THE INVENTION

The present invention relates to a system for determining abnormalities in daily activity patterns that observes the daily activity patterns of a person to be observed and detects the abnormalities of the person to be observed.

Conventional systems for determining abnormalities in daily activity patterns pay attention to one or more daily activity patterns and determine that a person to be observed is abnormal if the person to be observed behaves unusually and, then, notifies an observer of the abnormalities. Here, the daily activity patterns refer to usual patterns of behavior in daily life, such as wake-up and cooking.

More specifically, sensors for detecting the daily activity patterns are disposed in rooms, and the daily activity patterns are grasped by storing outputs from the sensors. In addition, thresholds for determining whether the person to be observed is normal or abnormal are defined by performing statistical analyses and other processes based on the stored data, and the observer is notified when any detected value is larger or smaller than the corresponding threshold.

Further, there is also disclosed a system for determining abnormalities in daily activity patterns that, when the abnormalities of the person to be observed are determined, not only detects a vital reaction but also considers the space where the person to be observed resides and the details of the behavior so that the abnormalities of the person to be observed can be detected more reliably (for example, see Japanese patent Laid-open No. 2002-352352, pp. 4–8, FIGS. 1, 2 and 3).

SUMMARY OF THE INVENTION

In the conventional systems for determining the abnormalities in the daily activity patterns, it is necessary to pay attention to a plurality of daily activity patterns so as to determine the abnormalities of the person to be observed more reliably. However, the specific daily activity pattern to which attention should be paid in order to increase the rate of correct abnormality determination differs between persons. More specifically, Although the daily activity patterns must be stable on a daily basis in order to detect abnormalities of the person to be observed, the specific stable daily activity pattern differs between persons and, therefore, the conventional systems pay attention also to the daily activity patterns that are not suitable for determining abnormalities of the person to be observed uselessly.

Therefore, in order to solve the above problem, it is an object of the present invention to provide a system for determining abnormalities in daily activity patterns that can eliminate useless operations by learning the daily activity patterns that are optimal for the abnormality detection for each observed person so as not to pay attention to unsuitable daily activity patterns.

The above object can be achieved by providing a system for determining abnormalities in daily activity patterns, wherein: one or more sensors for detecting arbitrary daily activity patterns of a person to be observed, and a data processing apparatus including databases for storing detection output data, a statistical analysis section, an abnormality determination section, an evaluation section and a notification section are provided in a home of a person to be observed; a reporting apparatus and communication means are provided in an observer's home; the data detected by the sensors is stored in the databases of the data processing apparatus; the statistical analysis section performs statistical analyses of the stored data and calculates thresholds for detecting the daily activity patterns; the abnormality determination section compares the living behavioral values with the thresholds calculated by the abnormality determination section and determines abnormalities; the notification section notifies the reporting apparatus of the abnormalities; the reporting apparatus reports the abnormalities of the person to be observed to the observer; and the observer checks whether the person to be observed is actually abnormal or not by communicating with the person to be observed via the communication means and gives feedback about whether the abnormality notification input from the evaluation input device is correct or incorrect, thereby learning which daily activity patterns are optimal for the abnormality determination. Here, the learning is to automatically determine which daily activity patterns detect the abnormalities of the person to be observed more accurately with the help of the feedback.

According to the present invention, when the abnormalities of the person to be observed are determined, useless operations can be eliminated without reducing the rate of correct abnormality determination by learning the optimal daily activity patterns for each specific observed person so as not to pay attention to unsuitable daily activity patterns.

BRIEF DESCRIPTION OF THE DRAWINGS

FIG. 8 is a diagram showing a destination table of a central server in the second embodiment.

DESCRIPTION OF THE PREFERRED EMBODIMENTS

Hereinafter, preferred embodiments of the present invention will be described with reference to the drawings.

Figure 1:
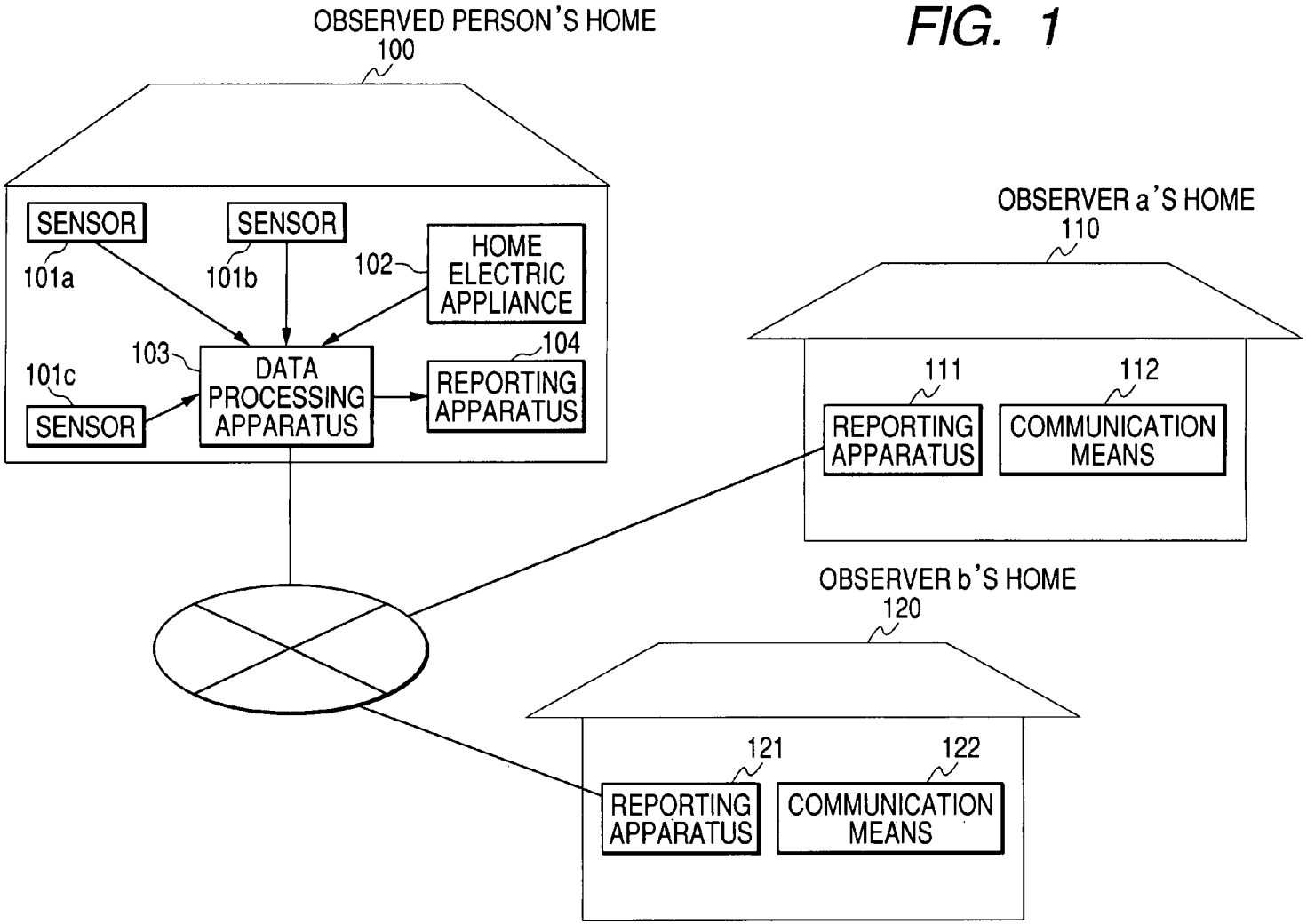
FIG. 1 is a schematic configuration diagram showing a first embodiment of the present invention.

FIG. 1 is a schematic configuration diagram of an embodiment of the present invention. There are shown a home of a person to be observed 100 and homes 110 and 120 of observers a and b, respectively. The home of the person to be observed 100, the observer a's home 110 and the observer b's home 120 are interconnected via a network such as the Internet. Sensors 101*a*, 101*b* and 101*c* are existence sensors for detecting existence of the person to be observed such as, for example, pyroelectric infrared sensors, or motion sensors for detecting motion of the person to be observed such as, for example, CMOS imaging devices or CCDs. The sensors 101*a*, 101*b* and 101*c* detect daily activity patterns of the person to be observed. Home electric appliances 102 such as a refrigerator, an electric lamp and the like are equipped with functions to detect conditions of the home electric appliance such as opening/closing of the refrigerator and on/off of the electric lamp and to transmit the detected conditions. A data processing apparatus 103 collects detection result data from the sensors 101*a*, 101*b* and 101*c* and the home electric appliance 102 to perform statistical analyses and abnormality determination. A reporting apparatus 104 reports abnormalities by using reporting means such as an alarm when the data processing apparatus 103 determines that there are the abnormalities. The sensor 101*a*, 101*b* and 101*c*, the home electric appliance 102, the data processing apparatus 103 and the reporting apparatus 104 are provided in the home of the person to be observed 100. A reporting apparatus 111 and a communication means 112 such as a telephone are provided in the observer a's home 110. Similarly, a reporting apparatus 121 and a communication means 122 are provided in the observer b's home 120. When the data processing apparatus 103 determines that there are abnormalities, the reporting apparatuses 111, 121 receive the abnormality determination via a network and report the abnormalities by using the reporting means such as alarms. Further, the reporting apparatuses 111, 121 each comprise means for transmitting to the data processing apparatus 103 whether the abnormality determination is incorrect or not. The communication means 112, 122 are means for allowing the observers to check the safety of the person to be observed, which can be implemented by telephones, facsimiles, personal computers and the like. Here, although three sensors, one home electric appliance and two observer's homes are shown in FIG. 1, more numbers of these elements may be provided. Further, although two observer's homes are shown in FIG. 1, these may be one or three or more.

Figure 2:
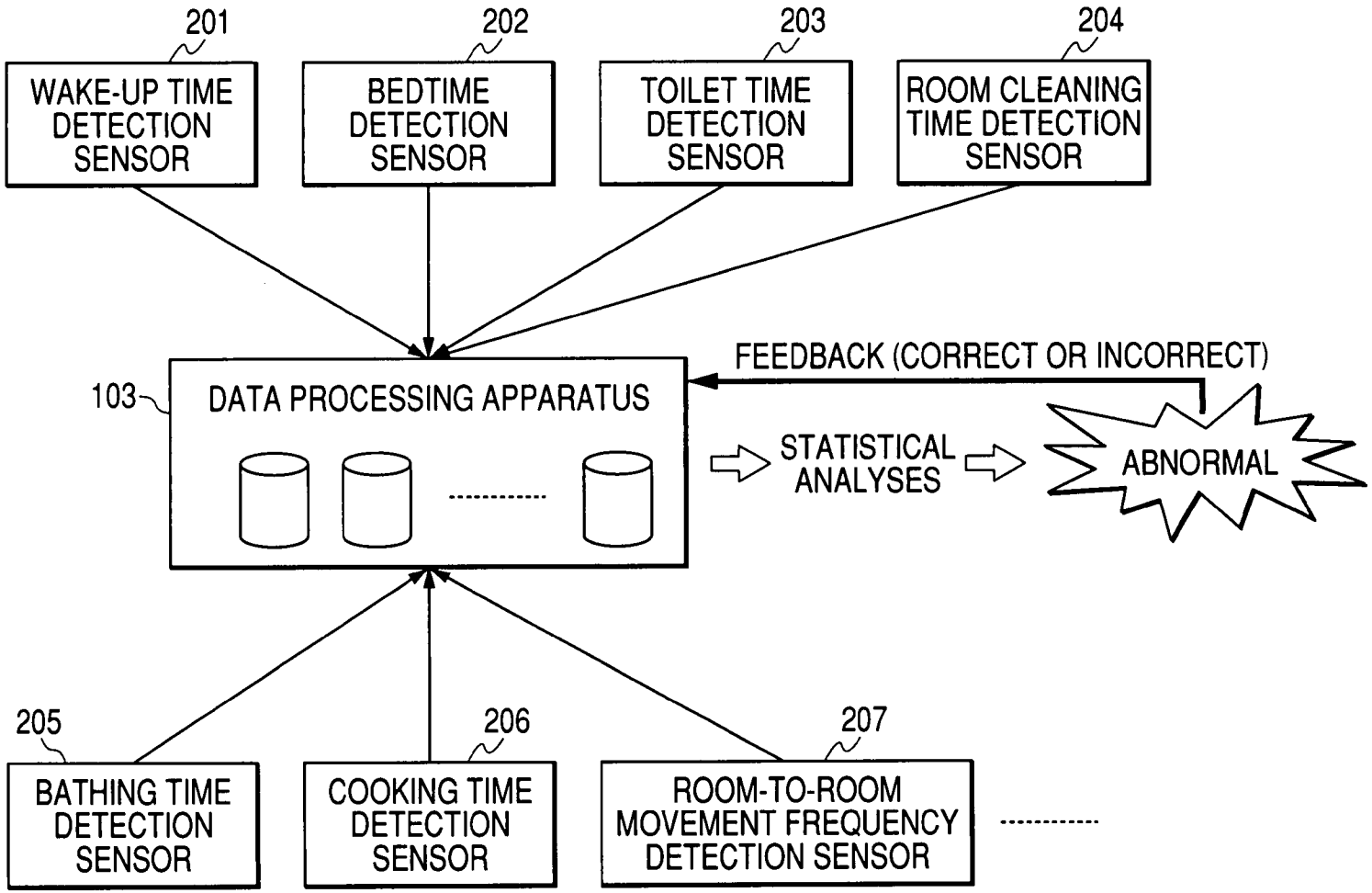
FIG. 2 is a diagram schematically showing a process in a home of a person to be observed in the first embodiment.

FIG. 2 schematically shows a process in the home of the person to be observed. A wake-up time detection sensor 201 detects wake-up time in the daily activity patterns and is comprised of one or more sensors or one or more home electric appliances for detecting the wake-up time. For example, the wake-up time may be detected by detecting existence of a person on a bed by using a pyroelectric infrared sensor, detecting that a television set is turned on in the morning or detecting opening/closing of the door of a toilet in the morning. A bedtime detection sensor 202 detects bedtime in the daily activity patterns and is comprised of one or more sensors or one or more home electric appliances for detecting the bedtime. For example, the bedtime may be detected by detecting existence of the person on the bed by using the pyroelectric infrared sensor, detecting that the television set is turned off at night or detecting the electric lamp being turned off. A toilet time detection sensor 203 detects toilet-using time in the daily activity patterns and is comprised of one or more sensors or one or more home electric appliances for detecting the time when the toilet is used. For example, the time when the toilet is used may be detected by detecting existence of a person in the toilet by using the pyroelectric infrared sensor, detecting opening/closing of the door of the toilet or detecting that the electric lamp in the toilet is turned on/off. A room-cleaning time detection sensor 204 detects room-cleaning time in the daily activity patterns and is comprised of one or more sensors or one or more home electric appliances for detecting the time when the person to be observed cleans his/her room. For example, the time when the person to be observed cleans his/her room may be detected by detecting that a vacuum cleaner is turned on/off or through image recognition by using a CMOS imaging device or CCD.

A bathing time detection sensor 205 detects bathing time in the daily activity patterns and is comprised of one or more sensors or one or more home electric appliances for detecting the time when the person to be observed takes a bath. For example, the bathing time may be detected by detecting existence of a person in the bathroom by using the pyroelectric infrared sensor, detecting opening/closing of the door of the bathroom or detecting that the electric lamp in the bathroom is turned on/off. A cooking time detection sensor 206 detects cooking time in the daily activity patterns and is comprised of one or more sensors or one or more home electric appliances for detecting the time when the person to be observed is cooking. For example, the cooking time may be detected by detecting existence of a person in the kitchen by using the pyroelectric infrared sensor, detecting the number of opening/closing of the door of the refrigerator, detecting that a rice cooker is turned on/off, detecting that a gas range or an IH (Induction-Heating) cooking heater is turned on/off or detecting other cooking home electric appliances are turned on/off.

A room-to-room movement frequency detection sensor 207 detects the number of movement between rooms in the daily activity patterns and is comprised of one or more sensors or one or more home electric appliances for detecting the number of movement between the rooms. For example, the number of movement between the rooms may be detected by detecting existence of a person in the rooms by using the pyroelectric infrared sensors, detecting opening/closing of the doors of the rooms, detecting that the electric lamps in each room are turned on/off or detecting that other home electric appliances in each room are turned on/off. Data of the daily activity patterns is detected by these detection sensors and transmitted to the data processing apparatus in a wireless or wired manner and, then, the transmitted data is stored in databases of the data processing apparatus 103. Every time the data processing apparatus 103 receives the data of the daily activity patterns from the detection sensors, it performs the statistical analyses of the stored data so as to determine whether the received daily activity pattern is abnormal or not. If it is determined that the received daily activity pattern is abnormal, the reporting apparatus 104 in the home of the person to be observed 100 or the reporting apparatuses 111, 121 in the observer's homes 110, 120 are informed of the abnormality. In response to the abnormality notification, the person to be observed or the observers checks whether the abnormality notification is correct or not and gives the data processing apparatus 103 feedback about whether the abnormality notification is correct or not. Based on the feedback information, the data processing apparatus 103 determines whether the daily activity patterns that have been considered abnormal correspond to the actual abnormalities or not and learns the daily activity patterns unique to the person to be observed. Here, although examples of the sensors for detecting the daily activity patterns include only the wake-up time detection sensor 201, the bedtime detection sensor 202, the toilet time detection sensor 203, the room cleaning time detection sensor 204, the bathing time detection sensor 205, the cooking time detection sensor 206 and the room-to-room movement frequency detection sensor 207 as described above, other sensors for detecting the daily activity patterns may be provided.

Figure 3:
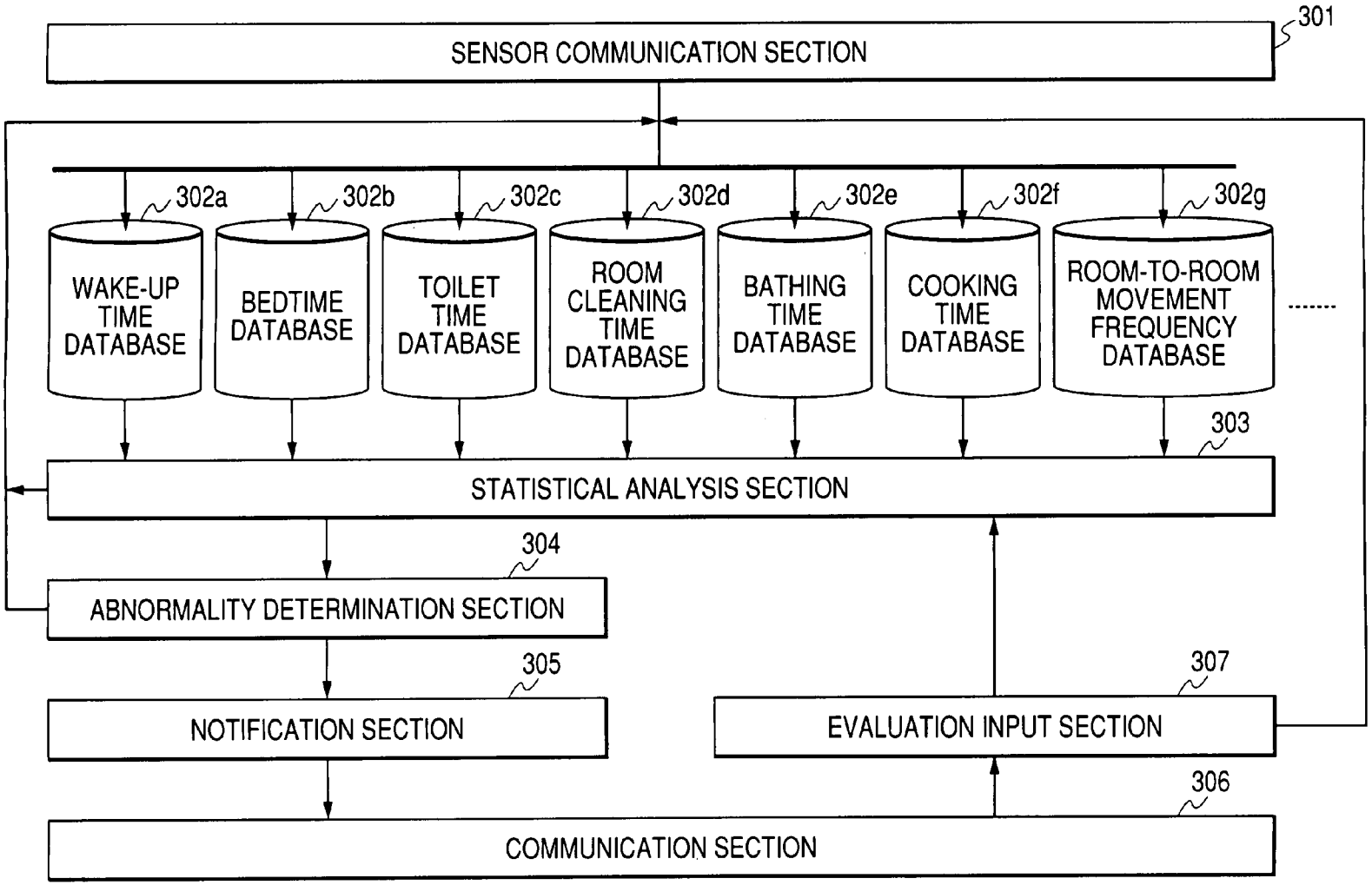
FIG. 3 is a block diagram of a data processing apparatus in the first embodiment.

FIG. 3 is a block diagram of the data processing apparatus 103. The data processing apparatus 103 includes: a sensor communication section 301; a wake-up time database 302*a*; a bedtime database 302*b* for storing the bedtime; a toilet time database 302*c* for storing the toilet using time; a room cleaning time database 302*d* for storing the room cleaning time; a bathing time database 302*e* for storing the bathing time; a cooking time database 302*f* for storing the cooking time; and a room-to-room movement frequency database 302*g* for storing the number of movement between the rooms. The data processing apparatus further include: a statistical analysis section 303; an abnormality determination section 304; a notification section 305; a communication section 306; and an evaluation input section 307. The sensor communication section 301 receives the detection data from the sensors or home electric appliances that detect the daily activity patterns. The wake-up time database 302*a* stores the wake-up time in the detection data of the daily activity patterns received by the sensor communication section 301. The statistical analysis section 303 performs the statistical analyses of the data stored in each database. The abnormality determination section 304 determines whether the daily activity pattern data received through the sensor communication section 301 is abnormal or not based on the result of the statistical analyses in the statistical analysis section 303. The notification section 305 notifies of abnormalities when the abnormality determination section 304 determines that the daily activity pattern data is abnormal. The communication section 306 communicates with the reporting apparatus 104 in the home of the person to be observed 100 or communicating with the observer's homes 110 and 120 via a network such as the Internet. The evaluation input section 307 inputs whether the abnormality determination is correct or not.

Figures 4, 5:
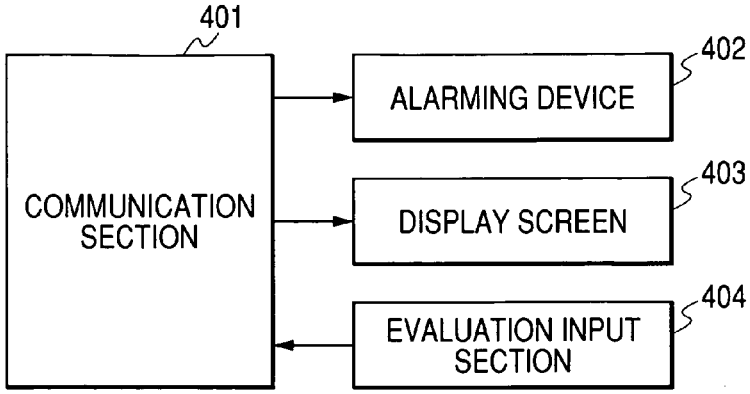
FIG. 4 is a block diagram of a reporting apparatus in the first embodiment.
FIG. 5 is a diagram showing a bathing time database in the data processing apparatus.

FIG. 4 is a block diagram of the reporting apparatuses 104, 111 and 121. These apparatuses are configured similarly to each other. Each of the reporting apparatuses includes a communication section 401, an alarming device 402, a display screen 403, and an evaluation input section 404. The communication section 401 communicates with the data processing apparatus 103 in a wired or wireless manner or via a network such as the Internet. The alarming device 402 gives an alarm when the communication section 401 receives the abnormality notification from the data processing apparatus 103. The display screen 403 displays that the person to be observed is abnormal when the communication section 401 receives the abnormality notification from the data processing apparatus. The evaluation input section 404 inputs whether the abnormality notification is correct or not.

FIG. 5 is an example of the bathing time database 302*c* in the data processing apparatus 103. The bathing time database 302*e* includes fields such as: a bathing time field 401 for storing a bathing time in one day in minutes; a threshold field 402 for determining abnormalities; an abnormality determination field 403 for showing abnormality determination; an evaluation field 404 for showing whether the abnormality determination is correct or incorrect; and an error rate field 405 for showing a rate of incorrect abnormality determination. Although the bathing time database 302*c* in the data processing apparatus 103 is exemplified in FIG. 5, it is to be noted that other databases in the data processing apparatus 103 are configured similarly.

Figure 6:
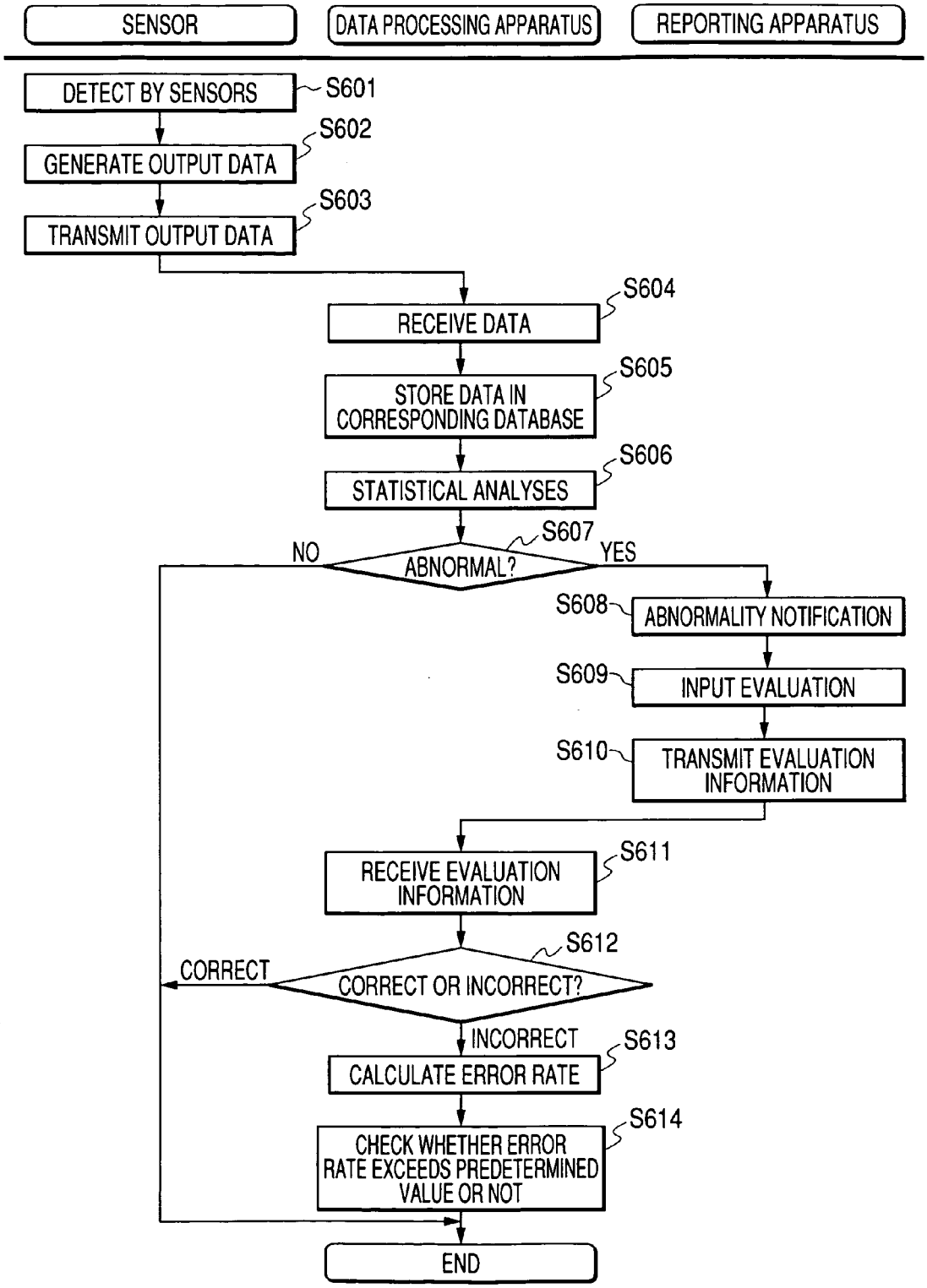
FIG. 6 is a flow chart showing an operating process in the first embodiment.

FIG. 6 is a flow chart showing operating procedures of the daily activity pattern detection sensors, the data processing apparatus and the reporting apparatus in this embodiment. When the daily activity pattern detection sensors such as the wake-up time detection sensor 201, the bedtime detection sensor 202 and so on detect the daily activity patterns (step S601), the sensors generate output data according to the daily activity patterns (step S602). The sensors then transmit the generated output data to the data processing apparatus 103 in a wireless or wired manner. For example, if the detected daily activity pattern is the wake-up time, the time when the wake-up is detected is generated as the output data and transmitted to the data processing apparatus 103 (step S603).

When the data processing apparatus 103 receives the output data transmitted in step S603 at the sensor communication section 301 (step S604), it stores the received data in a database corresponding to the daily activity pattern represented by the received data (step S605). For example, if the received data comes from the bathing time detection sensor 205, the data is stored in the bathing time field 401 of the bathing time database 302*e*. Next, the statistical analysis section 303 performs statistical analyses of the data stored in the databases and calculates the thresholds to determine abnormalities (step S606). Then, the calculated thresholds are stored in the threshold fields of the corresponding databases. The thresholds are calculated using the following equation (1) by way of example in this embodiment:

$$\text{Threshold}=\text{Average value}-2.33\times\text{Standard deviation} \qquad \text{Equation (1)}$$

Next, the abnormality determination section 304 determines whether the data of the daily activity pattern is larger than the threshold calculated in the statistical analyses of step S606. If the data is larger, it is determined that the daily activity pattern is abnormal. If the data is smaller, the daily activity pattern is normal (step S607). Here, in some daily activity patterns, the data smaller than the threshold may mean abnormalities. Then, the determination results are stored in the abnormality determination fields of the corresponding databases. If it is determined that the daily activity patterns are normal in step S607, a series of processes terminates. On the other hand, if it is determined that the daily activity patterns are abnormal in step S607, the notification section 305 generates a command or signal to notify that the daily activity patterns are abnormal. In addition, the communication section 306 transmits the abnormality notification consisting of the command or signal to the reporting apparatuses that are registered as notification destinations in advance. Incidentally, the reporting apparatuses are registered as the notification destinations in advance; however, they may be newly added or deleted. In this case, an interface to add or delete the reporting apparatuses must be provided.

The reporting apparatus receives the abnormality notification transmitted by the data processing apparatus 103 at the communication section 401 and notifies the observers and the like of the abnormalities by giving an alarm of the alarming device 402 or indicating that the person to be observed is abnormal on the display screen 403 (step S608). Incidentally, the indication of the abnormalities may be shown on the display screen 403 at the same time when the alarm is given by the alarming device 402. When the observers receive the abnormality notification from the reporting apparatus, the observers check the safety of the person to be observed using communication means such as telephone and determine whether the person to be observed is actually abnormal or not. The observers then input the determination result to the evaluation input section 404 (step S609). It is to be noted that the person to be observed may input the evaluation of whether the abnormality determination is correct or not through the evaluation input section 404 of the reporting apparatus 104 or the evaluation input section 307 of the data processing apparatus 103 in the home of the person to be observed 100. The evaluation command or signal that is input in step S609 is transmitted from the communication section 401 of the reporting apparatus to the data processing apparatus 103 (step S610). The data processing apparatus 103 receives the evaluation information transmitted from the reporting apparatus at the communication section 306 (step S611). Then, the evaluation information is stored in the evaluation field of the corresponding database of the corresponding daily activity patterns. The data processing apparatus 103 checks whether the abnormality determination is evaluated to be "correct" or "incorrect" (step S612). If it is evaluated to be "correct" or, in other words, if the abnormality determination made in step S607 corresponds to the actual abnormalities, the data processing apparatus 103 terminates the series of processes. On the other hand, if the evaluation information shows that the abnormality determination was "incorrect", the data processing apparatus 103 calculates the error rate that shows the rate of the cases in which the abnormality determination was made incorrectly up to that time (step S613).

If the error rate exceeds a predetermined value, the data processing apparatus 103 determines that the pertinent daily activity patterns are not suitable for detecting the abnormalities of the person to be observed. As a result, the data processing apparatus 103 decides not to perform the process in relation to the pertinent daily activity patterns after that (step S614). Then, the series of processes are terminated. Incidentally, the predetermined rate may be changed by the person to be observed or the observers. In this case, an interface must be provided so as to allow the person to be observed or the observers to change the predetermined rate. Further, in step S614, it is preferable to make the determination after calculating the error rate several times.

According to this embodiment, when the abnormalities of the person to be observed are determined, since the correctness of the abnormality determination in relation to the daily activity patterns is evaluated and the feedback about the result of the evaluation is given, it is possible to learn the daily activity patterns optimal for each observed person and thereby eliminate the processes in relation to the unsuitable daily activity patterns.

In the system for determining the abnormalities in the daily activity patterns of this embodiment, the home electric appliances that transmit their own states such as whether the power is on/off in place of the sensors are connected to the data processing apparatus individually; however, the home electric appliances may alternatively be connected via a network such as a home network. Similarly, although the sensors are connected to the data processing apparatus individually, the sensors may alternatively be connected via a network such as a sensor network. Further, although the sensors and home electric appliances transmit the detection results of the daily activity patterns in the example described above, the daily activity patterns may be detected by allowing the data processing apparatus to make a periodical inquiry. In this case, if the data processing apparatus conforms to universal networking standards, common networking home appliances and sensors may be used.

Although the reporting apparatus and the communication means are provided separately in the observer's home in the system for determining the abnormalities in the daily activity patterns of this embodiment, the communication means may alternatively be included in the reporting apparatus. This makes it possible to reduce the number of components of the system.

Although the abnormalities are determined by using the equation (1) in the system for determining the abnormalities in the daily activity patterns of this embodiment, other determination methods may alternatively be used. Therefore, conventional systems for determining the abnormalities in the daily activity patterns may also be used.

Further, by detecting the unsuitable daily activity patterns, the sensors for detecting the unsuitable daily activity patterns can be eliminated and, eventually, the cost for detecting the daily activity patterns can be reduced. Moreover, when one data processing apparatus processes the data on a plurality of observed persons, such as in the case of a condominium devoted exclusively to elderly people, a burden on the data processing apparatus can also be reduced by reducing the number of the daily activity patterns for each observed person.

Next, according to a second embodiment, a system for determining abnormalities in daily activity patterns in which the abnormalities are notified not to an observer such as a relative of a person to be observed but to an observation center or a service center will be described.

Figure 7:
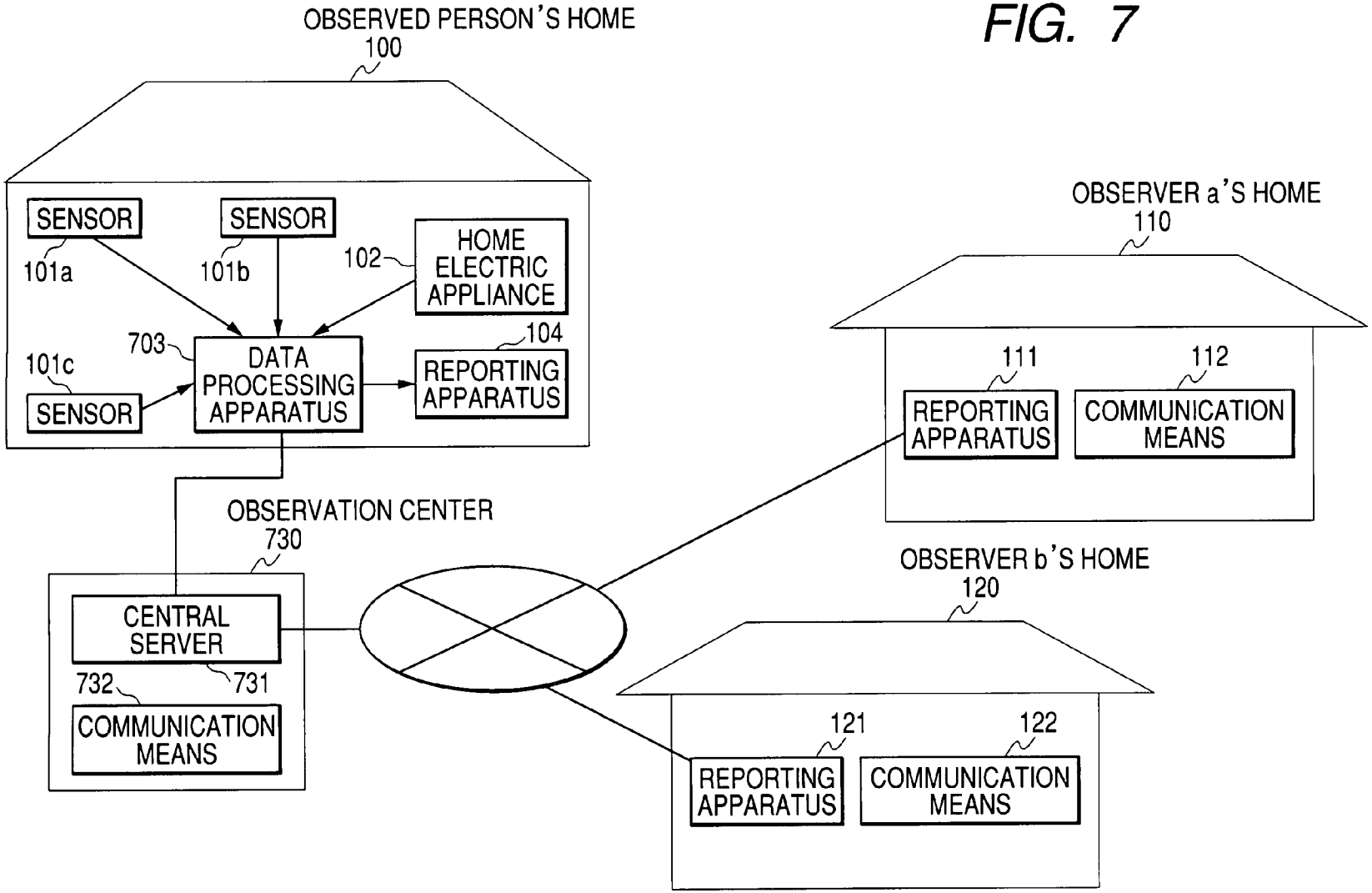
FIG. 7 is a schematic configuration diagram showing a second embodiment of the present invention.

FIG. 7 is a schematic configuration diagram showing a second embodiment of the present invention. In FIG. 2, an observation center 730 is newly added to the configuration of FIG. 1. The home of the person to be observed 100 is linked to the observation center 730 via a dedicated line or a network such as the Internet. The observation center 730 is linked to the observer a's home 110 and the observer b's home 120 via a network such as the Internet. The observation center 730 includes a central server 731 for performing centralized administration of the persons to be observed and the observers and a communication means 732 for communicating with the persons to be observed. The central server 731 includes a communication section and a destination table. The communication section communicates with the data processing apparatus 103 and the reporting apparatuses in the homes of the person to be observed. The destination table assigns IDs to the persons to be observed and registers destinations of the abnormality notification for each observed person.

FIG. 8 is an example of the destination table. The destination table includes: an observed person ID field 801; a destination field 802 for storing IP addresses, e-mail addresses and the like of destinations of the abnormality notification; and a communication method field 803 for storing communication methods. The destination table stores the destinations and the communication methods for each observed person and, therefore, can accommodate the case when the abnormality notification is transmitted to a plurality of destinations. When the abnormality notification is transmitted to the destination by TCP/IP applications, an IP address is stored in the destination field and the communication method field is flagged as the "TCP/IP applications". In addition, when the abnormality notification is transmitted as e-mail, an e-mail address is stored in the destination field and the communication method field is flagged as the "e-mail". As described above, the destinations and the communication methods are stored for all observed-persons.

As with the first embodiment, the daily activity patterns of the persons to be observed are detected by the daily activity pattern detection sensors and stored in the data processing apparatus 103 and, then, the data processing apparatus 103 determines whether the daily activity patterns are abnormal or not by statistical analyses. If it is determined that the daily activity patterns are abnormal, the data processing apparatus 103 transmits a command or signal to notify that the daily activity patterns are abnormal to the central server 731 of the observation center 730. When the central server 731 receives the command or signal, the observation center 730 checks whether the person to be observed is actually abnormal by using the communication means 732 and transmits the evaluation of the abnormality notification through the central server 731 to the data processing apparatus 103. If the person to be observed is actually abnormal, the observation center 730 refers to the destination table of the central server 731 and notifies of the abnormalities to the destinations for the corresponding observed person's ID. When receiving the abnormality notification from the central server, the reporting apparatus of the observer's home reports to the observer that the person to be observed is abnormal. The observer may either check the safety of the person to be observed by using the communication means or run to the home of the person to be observed at once. The data processing apparatus 103 of the home of the person to be observed 100 receives the evaluation information from the central server 731 and, as with the first embodiment, calculates the error rate (step S613) and determines whether the error rate exceeds a predetermined rate (step S614) so as to decide not to perform the process in relation to the daily activity patterns that are not suitable for the person to be observed.

According to this embodiment, since the observation center evaluates the abnormality determination of the person to be observed, the burden on the observer can be reduced. Further, since the observation center is provided, a service using the system for determining the abnormality in daily activity patterns according to the present invention can be offered.

Although the data processing apparatus is provided in the home of the person to be observed in the system for determining the abnormalities in the daily activity patterns according to this embodiment, it may alternatively be provided in the central server. This makes it possible to reduce the equipment cost in relation to the home of the person to be observed to be reduced. In this case, each daily activity pattern detection sensor must have features to communicate with the central server.

What is claimed is:

1. A system for determining abnormalities in daily activity patterns that detects the abnormalities in the daily activity patterns of a person to be observed and notifies of the abnormalities, comprising:

daily activity pattern detection means for detecting the daily activity patterns;

data storage means for storing detection results;

abnormality determination means for performing statistical analyses of the stored data and determining the abnormalities;

evaluation means for notifying of the abnormalities of the person to be observed in response to the determined abnormalities and giving feedback about whether the abnormality determination result is correct or not; and daily activity pattern learning means for learning the daily activity patterns suitable for detecting the abnormalities of the person to be observed based on the feedback information.

2. A system for determining abnormalities in daily activity patterns according to claim 1, wherein:

daily activity pattern detection sensors comprising said daily activity pattern detection means and a data processing apparatus for processing detection data from said daily activity pattern detection sensors are provided in a home of a person to be observed; and a reporting apparatus for receiving the abnormality notification from said data processing apparatus and notifying of the abnormalities of the person to be observed is provided in an observer's home.

3. A system for determining abnormalities in daily activity patterns according to claim 2, further comprising an observation center for observing the abnormalities of the person to be observed by receiving the abnormality notification of the person to be observed and reporting to the observer in case of the abnormalities.

4. In a system for determining abnormalities in daily activity patterns according to claim 3, a central server comprising:

a destination table for storing observed persons and destinations of abnormality notification for the persons to be observed;

communication means for communicating with the data processing apparatus of said observer's home and the reporting apparatus of said observer's home;

evaluation input means for inputting whether the abnormality notification is correct or not when the notification of the abnormalities of the person to be observed is received from said data processing apparatus; and abnormality reporting means for reporting the abnormalities to the destination of said observed person by using said destination table when the notification is correct.

5. A central server according to claim 4, comprising a plurality of destination tables for storing a plurality of destination addresses and communication methods and enabling reporting by a plurality of reporting means.

6. A system for determining abnormalities in daily activity patterns according to claim 1, further comprising:

error rate determination means for determining an error rate of said abnormality determination by said evaluation; and daily activity pattern detection stopping means for stopping detection of said daily activity patterns according to the determination by said error rate determination means.

7. In a system for determining abnormalities in daily activity patterns that detects the abnormalities in the daily activity patterns of a person to be observed and notifies of the abnormalities, a daily activity pattern detection sensor device comprising:

one or more existence detection sensors for detecting existence of the person to be observed, one or more motion detection sensors for detecting motion of the person to be observed, a home electric appliance for detecting its own conditions, or all of said existence detection sensor, said motion detection sensor and said home electric appliance; and transmission means for transmitting detection results to other apparatuses.

8. A daily activity pattern detection sensor device according to claim 7, further comprising a home electric appliance having home network connection means for connecting to a home network, a sensor having sensor network connection means for connecting to a sensor network, or both the home electric appliance and the sensor.

9. In a system for determining abnormalities in daily activity patterns that detects the abnormalities in the daily activity patterns of a person to be observed and notifies of the abnormalities, a data processing apparatus comprising:

sensor communication means for communicating with a daily activity pattern sensor;

one or more daily activity pattern databases for storing detection results corresponding to said daily activity patterns;

statistical analysis means for performing statistical analyses of the data stored in said daily activity pattern databases and calculating thresholds for determining abnormalities in said daily activity patterns;

abnormality determination means for comparing the detection results of said daily activity patterns with the thresholds calculated by said statistical analysis means and determining whether said daily activity patterns are abnormal or not;

notification means for generating a command or signal indicating the abnormalities when said abnormality determination means determines the abnormalities and notifying a reporting apparatus of the abnormalities;

communication means for communicating with said reporting apparatus; and evaluation input means for inputting whether the reported abnormality notification is correct or not.

10. In a system for determining abnormalities in daily activity patterns that detects the abnormalities in the daily activity patterns of a person to be observed and notifies of the abnormalities, a reporting apparatus comprising:

an alarm for reporting abnormalities of a person to be observed by warning sound, a display screen for displaying the abnormalities of the person to be observed, or both the alarm and the display screen;

evaluation input means for inputting whether the reported abnormalities are correct or not; and communication means for receiving an abnormality notification command or signal and transmitting the evaluation information input by said evaluation input means.

* * * * *